US009761195B2

(12) United States Patent
Zheng

(10) Patent No.: US 9,761,195 B2
(45) Date of Patent: Sep. 12, 2017

(54) DRIVING CIRCUIT FOR INCREASING A DRIVING POWER SUPPLY VOLTAGE FOR A DISPLAY PANEL

(71) Applicant: SITRONIX TECHNOLOGY CORP., Hsinchu County (TW)

(72) Inventor: Jia-Chi Zheng, Hsinchu County (TW)

(73) Assignee: Sitronix Technology Corp., Hsinchu County (TW)

( * ) Notice: Subject to any disclaimer, the term of this patent is extended or adjusted under 35 U.S.C. 154(b) by 0 days.

(21) Appl. No.: 13/859,040

(22) Filed: Apr. 9, 2013

(65) Prior Publication Data

US 2013/0271446 A1 Oct. 17, 2013

Related U.S. Application Data

(60) Provisional application No. 61/622,569, filed on Apr. 11, 2012.

(51) Int. Cl.
*G09G 3/36* (2006.01)

(52) U.S. Cl.
CPC ..... *G09G 3/3696* (2013.01); *G09G 3/3648* (2013.01); *G09G 2320/0276* (2013.01); *G09G 2330/024* (2013.01)

(58) Field of Classification Search
CPC ..... G09G 3/3696; G09G 2330/024; G09G 2330/026; G09G 2310/0291
USPC ..... 345/210–212
See application file for complete search history.

(56) References Cited

U.S. PATENT DOCUMENTS

| | | | | |
|---|---|---|---|---|
| 6,198,645 | B1 * | 3/2001 | Kotowski et al. | 363/59 |
| 7,554,537 | B2 * | 6/2009 | Kamijo | H02M 3/07 345/211 |
| 8,773,938 | B2 * | 7/2014 | Sasaki | G06F 1/26 345/211 |
| 2004/0160436 | A1 * | 8/2004 | Tanaka | G09G 3/3696 345/211 |
| 2006/0139296 | A1 * | 6/2006 | Naiki et al. | 345/101 |
| 2007/0024555 | A1 | 2/2007 | Park et al. | |
| 2008/0278473 | A1 | 11/2008 | An | |
| 2010/0097361 | A1 | 4/2010 | Oku | |
| 2011/0199397 | A1 | 8/2011 | Ko et al. | |

(Continued)

FOREIGN PATENT DOCUMENTS

| | | | |
|---|---|---|---|
| CN | 101197120 | A | 6/2008 |
| JP | 2004-354518 | A | 12/2004 |
| TW | 200912860 | A | 3/2009 |

(Continued)

*Primary Examiner* — Kumar Patel
*Assistant Examiner* — Amy C Onyekaba
(74) *Attorney, Agent, or Firm* — Rosenberg, Klein & Lee

(57) ABSTRACT

The present invention provides a driving circuit for display panel, which comprises a power supply circuit and a driving unit. The power supply circuit outputs a driving power supply voltage. The driving unit produces a driving signal according to a data signal and the driving power supply voltage for driving the display panel. In addition, the voltage level of the driving power supply voltage increases to a predetermined level. Thereby, during the process of charging the display panel by the data driving circuit, the driving power supply voltage output by the power supply circuit increases from a low level to a predetermined level for reducing the power consumption of the driving circuit.

6 Claims, 5 Drawing Sheets

(56) References Cited

U.S. PATENT DOCUMENTS

| | | | | |
|---|---|---|---|---|
| 2011/0273425 | A1* | 11/2011 | Kojima et al. | 345/211 |
| 2012/0075280 | A1 | 3/2012 | Liu et al. | |

FOREIGN PATENT DOCUMENTS

| | | | |
|---|---|---|---|
| TW | 200915265 | A | 4/2009 |
| TW | 200917211 | A | 4/2009 |
| TW | 201133464 | A | 10/2011 |
| TW | 201214375 | A | 4/2012 |

* cited by examiner

DRIVING CIRCUIT FOR INCREASING A DRIVING POWER SUPPLY VOLTAGE FOR A DISPLAY PANEL

REFERENCE TO RELATED APPLICATION

This Application is based on Provisional Patent Application Ser. No. 61/622,569, filed 11 Apr. 2012.

FIELD OF THE INVENTION

The present invention relates generally to a driving circuit, and particularly to a driving circuit for display panel.

BACKGROUND OF THE INVENTION

Modern technologies are developing prosperously. Novel information products are introduced daily for satisfying people's various needs. Early displays are mainly cathode ray tubes (CRTs). Owing to their huge size, heavy power consumption, and radiation hazardous to the heath of long-term users, traditional CRTs are gradually replaced by liquid crystal displays (LCDs). LCDs have the advantages of small size, low radiation, and low power consumption, and thus becoming the mainstream in the market.

LCDs control the transmittance of liquid crystal cells according to data signals for displaying images. Because active-matrix LCD displays adopt active switching devices, such type of LCDs is advantageous for displaying motion pictures. Thin-film transistors (TFT) are the main switching devices used for active-matrix LCDs.

FIG. 1 shows a schematic diagram of the driving system for LCD according to the prior art. As shown in the figure, the driving system comprises a display panel 10, a scan driving circuit 12, a data driving circuit 14, a timing control circuit 16, and a gamma circuit 18. The display panel 10 is used for displaying images. The scan driving circuit 12 is used for producing and transmitting a plurality of scan signals to the display panel 10 for driving the display panel 10. The gamma circuit 18 is used for producing a plurality of gamma voltages. The data driving circuit 14 uses the plurality of gamma voltages produced by the gamma circuit 18 as the reference voltages and select the reference voltage according to a plurality of display dada for producing and transmitting a plurality of data signals to the display panel 10, so that the display panel 10 can display images according to the plurality of data signals. The timing control circuit 16 produces a timing control signal and transmits the scan control signal to the scan driving circuit 12 and the data control signal to the data driving circuit 14, respectively, for controlling the timing of the scan driving circuit 12 and the data driving circuit 14 transmitting the plurality of scan signals and the plurality of data signals, respectively, to the display panel 10.

FIG. 2 shows a waveform of the driving signal of the LCD according to the prior art. The gamma circuit 18 produces the reference voltages and supplies the reference voltages to a digital-to-analog converting circuit of the data driving circuit 14. The digital-to-analog converting circuit selects one of the reference voltages, produces a select voltage Vsel, and transmits the select voltage Vsel to a buffer of the data driving circuit 14. The buffer produces the driving signal according to the select voltage Vsel for driving the display panel 10. For the data driving circuit 14, the display panel 10 is equivalent to a first-order RC circuit.

As shown in FIG. 2, the basic charging process of the display panel 10 is shown. For brevity, the charging process, which includes the charge recycling process and the pre-drive process, is simplified. AVDD is the voltage produced by the power supply circuit for the buffer; Vsel is the select voltage selected by the digital-to-analog converting circuit and produced by selecting from the reference voltages; and SL is the voltage across the equivalent capacitor of the display panel 10. Assuming that the voltage across the equivalent capacitor is zero when the display panel 10 starts being charged, almost all of the voltage is across the equivalent resistor and the buffer. During the charging process of the display panel 10, the voltage across the equivalent capacitor is raised gradually, which makes the voltages across the equivalent resistor and the buffer get smaller. Then the shaded area in FIG. 2 is approximately equal to the lost energy. Thereby, how to reduced the lost energy and achieve the purpose of saving the power consumption of the driving circuit have become the aims for current manufacturers.

Accordingly, the present invention provides a driving circuit for display panel, which provides a increasing driving power supply voltage to the data driving circuit of the driving unit during the charging process of the display panel for reducing excessive power consumption.

SUMMARY

An objective of the present invention is to provide a driving circuit for display panel, which during the process of charging the display panel by the data driving circuit, provides a increasing driving power supply voltage to the driving circuit of the driving unit for reducing the power consumption of the driving circuit.

Another objective of the present invention is to provide a driving circuit for display panel, which during the process of charging the display panel by the data driving circuit, uses a voltage converting circuit as the power supply circuit for providing a increasing driving power supply voltage to the driving circuit of the driving unit for reducing the power consumption of the driving circuit.

Still another objective of the present invention is to provide a driving circuit for display panel, which during the process of charging the display panel by the data driving circuit, uses a charge pump circuit as the power supply circuit for providing a increasing driving power supply voltage to the driving circuit of the driving unit for reducing the power consumption of the driving circuit.

For achieving the objectives and effects described above, the present invention discloses a driving circuit for display, which comprises a power supply circuit and a driving unit. The power supply circuit outputs a power supply voltage; the driving unit produces a driving signal according to a data signal and the driving power supply voltage for driving the display panel. Besides, the voltage level of the driving power supply voltage increases to a predetermined level.

DETAILED DESCRIPTION

In the specifications and subsequent claims, certain words are used for representing specific devices. A person having ordinary skill in the art should know that hardware manufacturers might use different nouns to call the same device. In the specifications and subsequent claims, the differences in names are not used for distinguishing devices. Instead, the differences in functions are the guidelines for distinguishing. In the whole specifications and subsequent claims, the word "comprising" is an open language and should be explained as "comprising but not limited to". Beside, the word "couple" includes any direct and indirect electrical connection. Thereby, if the description is that a first device is coupled to a second device, it means that the first device is connected electrically to the second device directly, or the first device is connected electrically to the second device via other device or connecting means indirectly.

In order to make the structure and characteristics as well as the effectiveness of the present invention to be further understood and recognized, the detailed description of the present invention is provided as follows along with embodiments and accompanying figures.

Figure 1:
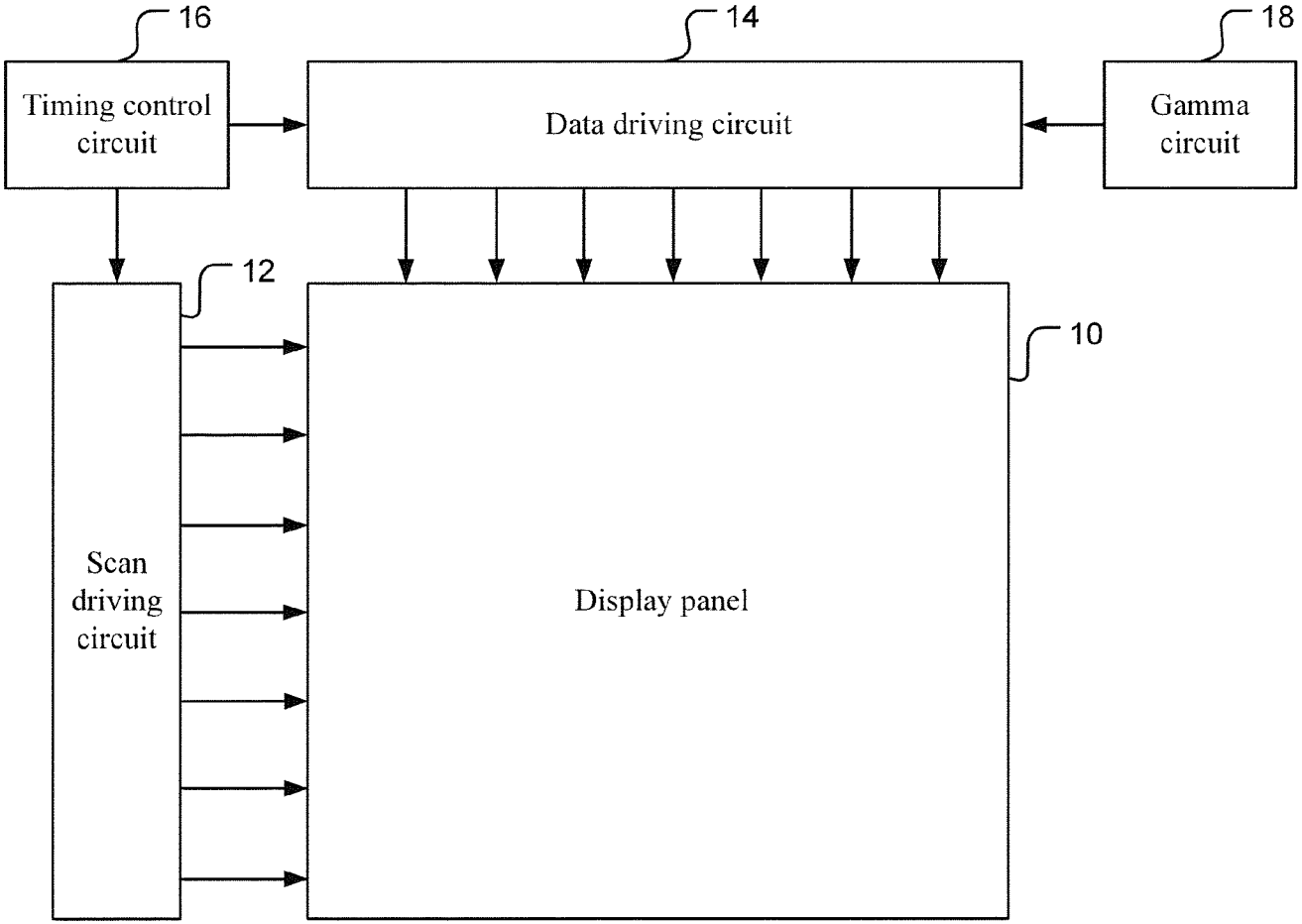
Figure 1 (Prior art)
FIG. 1 shows a schematic diagram of the driving system for LCD according to the prior art.
Figure 2:
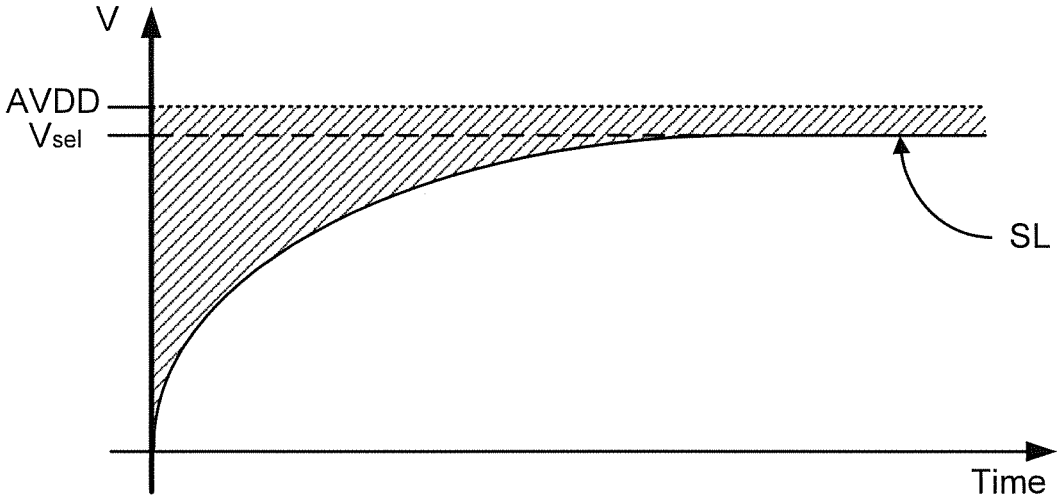
Figure 2 (Prior art)
FIG. 2 shows a waveform of the driving signal of the LCD according to the prior art.
Figure 3:
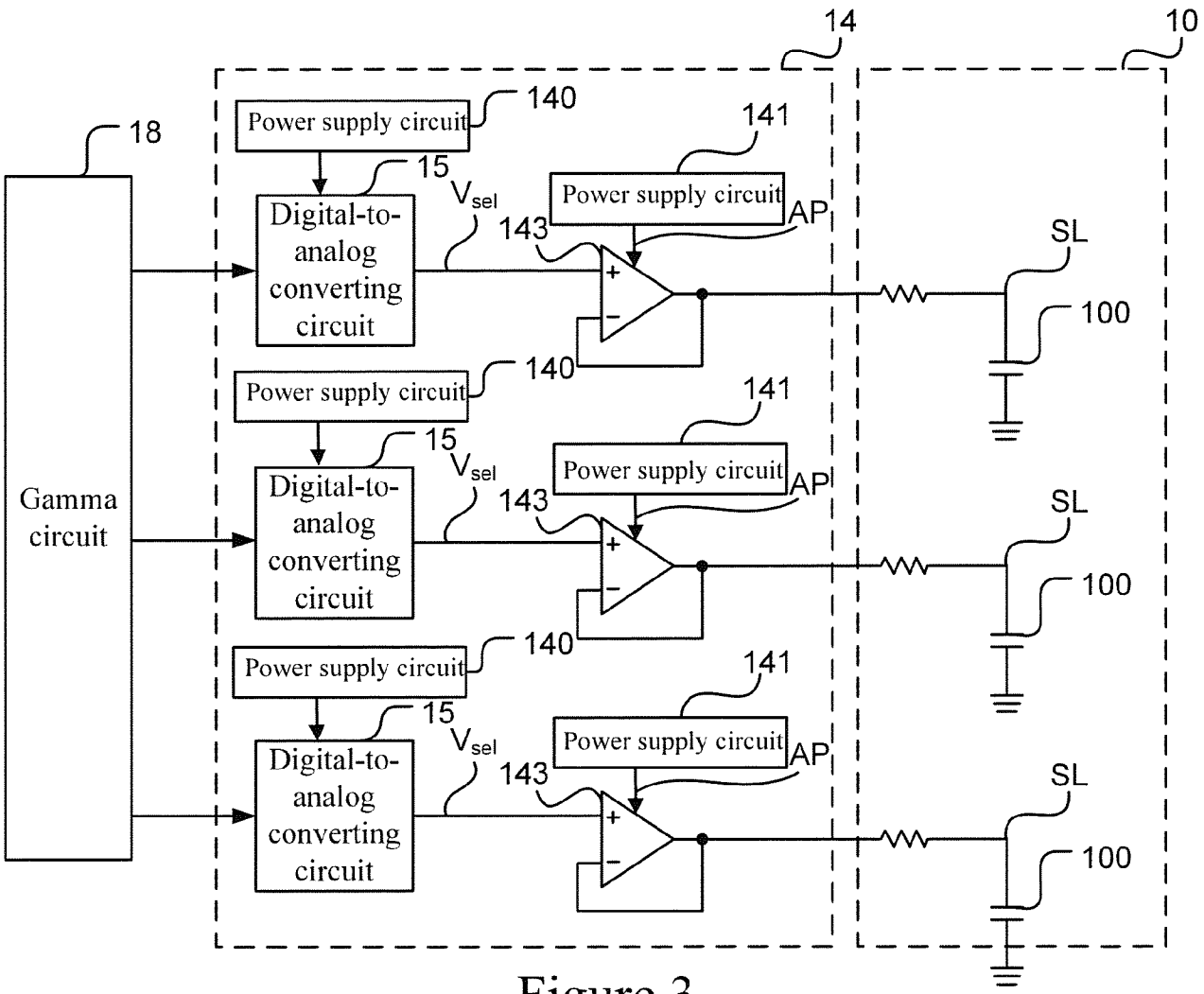
FIG. 3 shows a block diagram of the driving circuit for display panel according to the present invention.

FIG. 3 shows a block diagram of the driving circuit for display panel according to the present invention. As shown in the figure, the driving circuit for display panel according to the present invention is applied to the data driving circuit 14 for receiving the voltage level of the reference voltage produced by the gamma circuit 18. Thereby, the data driving circuit 14 according to the present invention comprises a plurality of driving units, which comprise a digital-to-analog converting circuit 15 and a buffer 143, respectively. In addition, the digital-to-analog converting circuit 15 and the buffer 143 of the plurality of driving units are coupled to different power supply circuits, respectively, for receiving different supplied power. The digital-to-analog converting circuit 15 of the plurality of driving units is coupled to a power supply circuit 140, which provides a fixed value of supplied voltage to the digital-to-analog converting circuit 15. Thereby, the digital-to-analog converting circuit 15 can select one of the reference voltages and produce the select voltage Vsel. The buffer 143 of the plurality of driving units is coupled to a power supply circuit 141. Here, only one driving unit is used for description. The power supply circuit 141 outputs a driving power supply voltage AP to the buffer 143. The buffer 143 produces a driving signal SL according to the driving power supply voltage AP and the select voltage Vsel produced by the digital-to-analog converting circuit 15, and outputs the driving signal SL to an equivalent capacitor 100 of the display panel 10. Then the driving signal SL is driven to charge the equivalent capacitor 100 for driving the display panel 10 to display images. Instead of being a fixed value, the voltage level of the driving power supply voltage AP increases gradually to a predetermined level AVDD. Besides, the buffer 143 is an operational amplifier.

Figure 5A:
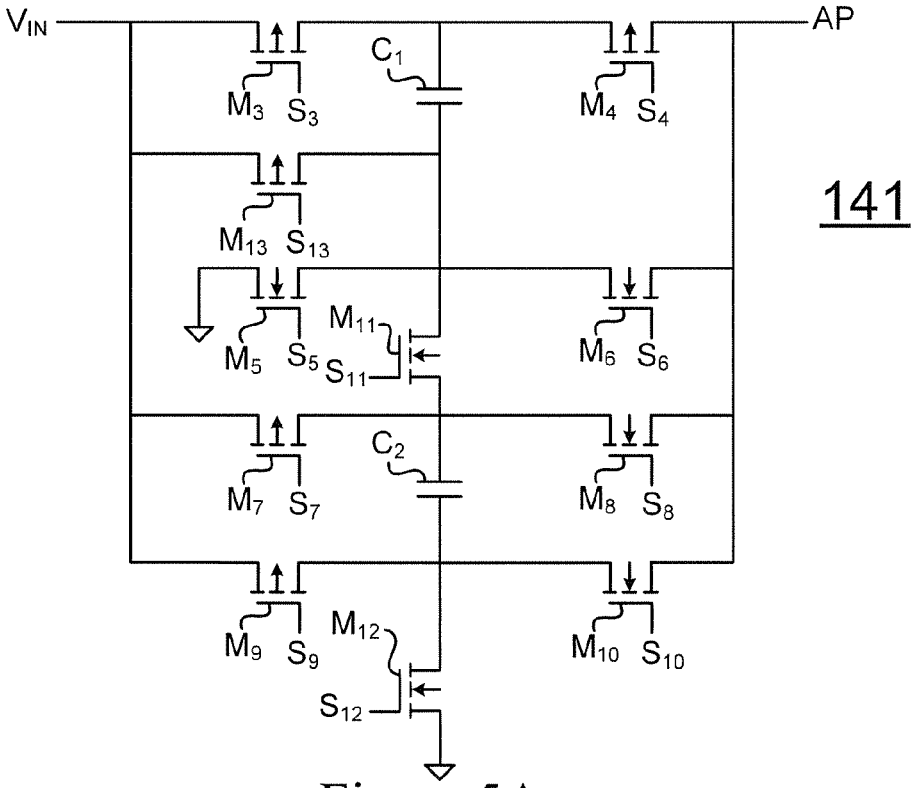
FIG. 5A shows a circuit diagram of the power circuit according to the second embodiment of the present invention.
Figure 5B:
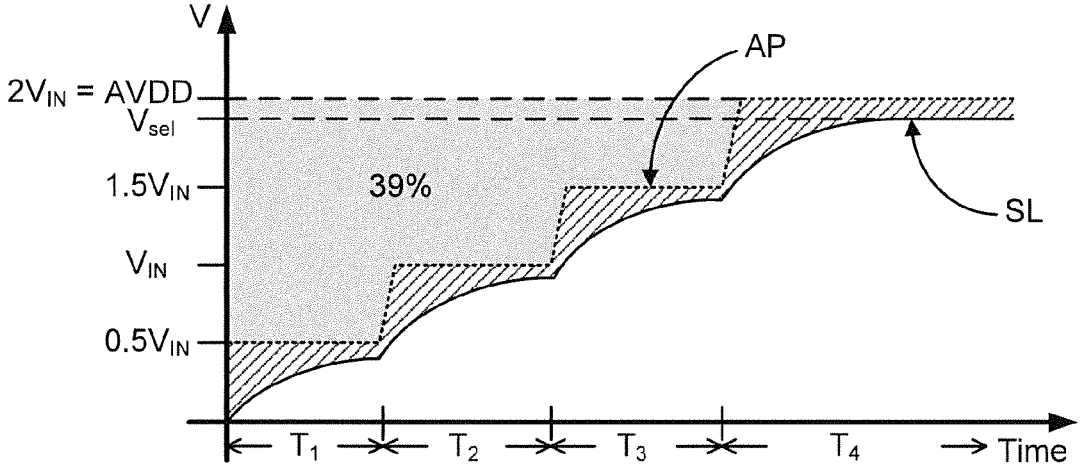
FIG. 5B shows a waveform of the driving signal according to the second embodiment of the present invention.

It is known from the above that the present invention achieves the objective of saving power by varying the voltage multiplication in the power supply circuit, which is a dc/dc converter, during the charging process of the display panel 10. As shown in FIG. 5B, during the charging process of the display panel 10, the voltage multiplication of the power supply circuit 141 is varied. Hence, the driving power supply voltage AP output by the power supply circuit 141 is switching gradually from a low voltage to the high voltage AVDD. At this moment, the voltages across the equivalent resistor and the buffer 143 are reduced substantially. In other words, the area of the shaded portion in FIG. 5B is decreased significantly, which means that the wasted energy can be reduced substantially and this achieving the objective of saving power. FIG. 5A is the embodiment of the power supply circuit for FIG. 5B. The power supply circuit 141 according to the present embodiment is a variable charge pump. Nonetheless, the present invention is not limited to the charge pump shown in FIG. 5A; it can be another power supply circuit 141. Those power supply circuits 141 having their output driving power supply voltages AP increasing gradually to the predetermined level AVDD during the charging process of the display panel 10 are within in the range of the present invention.

Figure 4A:
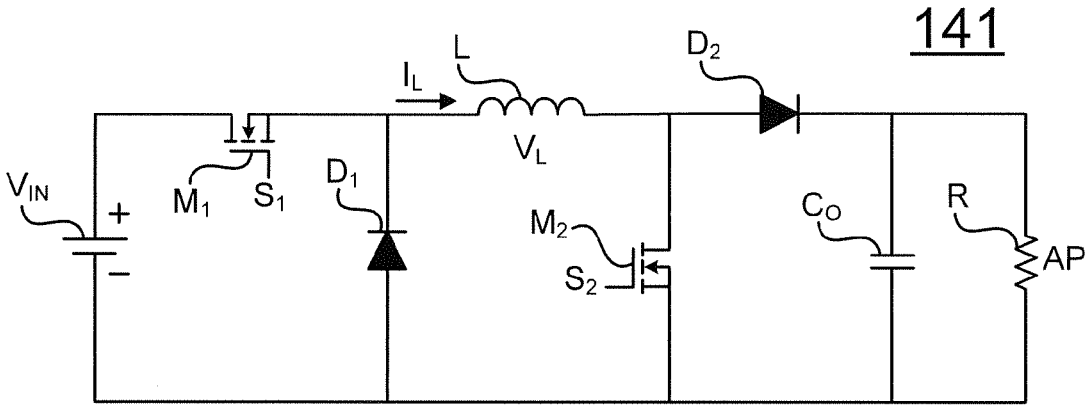
FIG. 4A shows a circuit diagram of the power circuit according to the first embodiment of the present invention.
Figure 4B:
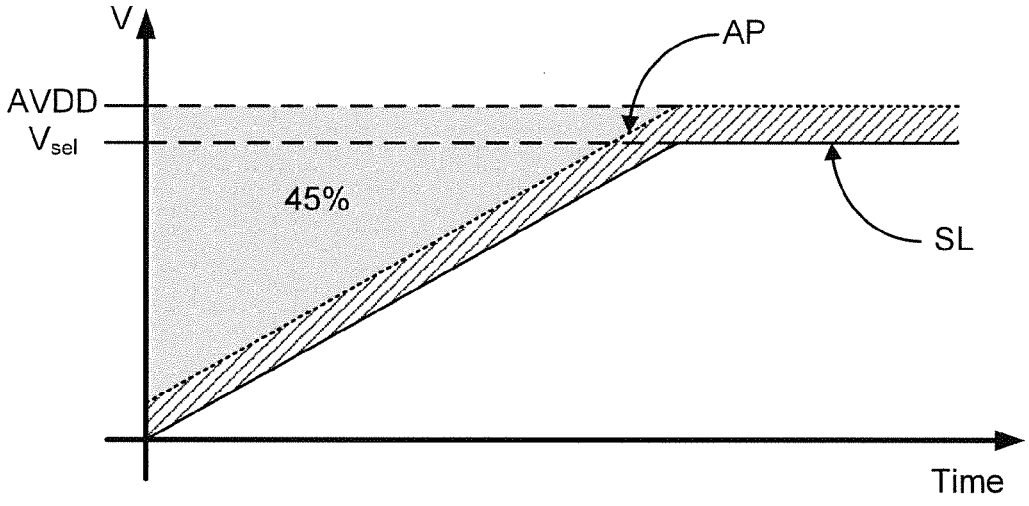
FIG. 4B shows a waveform of the driving signal according to the first embodiment of the present invention.

Besides, the power supply circuit 141 according to the present invention can be an inductive dc/dc converter, as shown in FIG. 4A. In FIG. 4B, during the charging process of the display panel 10, the gradually increasing output of the power supply circuit 141 is achieved by the control of the pulse-width modulation (PWM). In summary, the power supply circuit 141 according to the present invention is not limited any type of dc/dc converter. Once the output of the power supply circuit is increased gradually and the conversion efficiency is decent, the objective of saving power can be achieved. In the following, inductive and capacitive power supply circuits 141 are described in details.

Furthermore, the digital-to-analog converting circuit 15 is used for converting an input signal and producing the data signal. The digital-to-analog converting circuit 15 is coupled to the gamma circuit 18 and receives a plurality of gamma voltages produced by the gamma circuit 18. The plurality of gamma voltages are then used as the input signal and the display data. The digital-to-analog converting circuit 15 selects according to the display data. The gamma circuit 18 produces calibration data according to a gamma curve.

FIG. 4A shows a circuit diagram of the power circuit according to the first embodiment of the present invention. As shown in the figure, the power supply circuit 141 according to the present embodiment is a voltage converting circuit, which comprises a plurality of switches $M_1$ and $M_2$, a plurality of diodes $D_1$ and $D_2$, an inductor, and an output capacitor $C_O$. A first terminal of the switch $M_1$ is coupled to an input power supply voltage $V_{IN}$ and turns off or on the input power supply voltage $V_{IN}$ according to a switching signal $S_1$. The positive terminal of the diode $D_1$ is coupled to the negative terminal of the input power supply voltage $V_{IN}$; the negative terminal of the diode $D_1$ is coupled to a second terminal of the switch $M_1$. A first terminal of the inductor L is coupled to the second terminal of switch $M_1$. A first terminal of the switch $M_2$ is coupled to a second terminal of the inductor L; a second terminal of the switch $M_2$ is coupled to the negative terminal of the input power supply voltage $V_{IN}$. The positive terminal of the diode $D_2$ is coupled to the second terminal of the inductor L. A first terminal of the output capacitor $C_O$ is coupled to the negative terminal of the diode $D_2$; a second terminal of the output capacitor $C_O$ is coupled to the negative terminal of the input power supply voltage $V_{IN}$.

The power supply circuit 141 can make the voltage level of the driving power supply voltage AP increase gradually to the predetermined level via the step-up or the step-down mode. For example, while using the step-up mode, a plurality of switching signals $S_1$, $S_2$ are transmitted to the control terminal of the switches $M_1$, $M_2$ for turning them on. At this time, the input power supply voltage $V_{IN}$ charges the inductor L. Then the electrical energy is stored in the inductor in the form of magnetic energy. In addition, the current $I_L$ passing through the inductor L increases linearly. After a period of time, the switch $M_1$ is turned on and the switch $M_2$ is turned off continuously. At this moment, the polarity of the inductor voltage $V_L$ across both terminal of the inductor L is reversed, making the inductor L supply the current $I_L$ to the output capacitor $C_O$ and the load R continuously via the diode $D_2$. Because the inductor L is connected in series with the input power supply voltage $V_{IN}$, the output capacitor $C_O$ will be charged to the sum of the input power supply voltage $V_{IN}$ and the inductor voltage $V_L$. In other words, the voltage across the capacitor $C_O$ increases linearly and is equal to the driving power supply voltage AP, namely, $AP=V_{IN}+V_L$. Thereby, the voltage level of the driving power supply AP will be greater than the input power supply voltage $V_{IN}$.

As using the step-down mode, the plurality of switching signals $S_1$, $S_2$ are transmitted to the control terminal of the switches $M_1$, $M_2$ for turning the switch $M_1$ on and the switch $M_2$ off. At this time, the input power supply voltage $V_{IN}$ charges the inductor L and the output capacitor $C_O$ simultaneously. The inductor L is charged to the inductor voltage $V_L$ gradually and the output capacitor $C_O$ is charged gradually to $V_{IN}-V_L$. Afterwards, both of the switches $M_1$, $M_2$ are turned off. At this moment, the polarity of the inductor voltage $V_L$ across both terminal of the inductor L is reversed, making the inductor L supply the current $I_L$ to the output capacitor $C_O$ and the load R continuously via the diode $D_2$. According to the above description, the voltage across the capacitor $C_O$ is equal to the driving power supply voltage AP, namely, $AP=V_{IN}-V_L$. Thereby, the voltage level of the driving power supply AP will be smaller than the input power supply voltage $V_{IN}$.

The switches $M_1$, $M_2$ according to the present embodiment are not limited to any forms of switches. They can be any switching device well known to a person having ordinary skill in the art for turning on or off the power supply circuit 141.

Accordingly, the power supply circuit 141 according to the first embodiment of the present invention can use the step-up or down mode and PWM controlling of the switch for achieving the objective of providing the linearly and gradually increasing driving power supply voltage AP. FIG. 4B shows a waveform of the driving signal according to the first embodiment of the present invention. As shown in the figure, because the driving power supply AP increases linearly and gradually to the predetermined level AVDD from the voltage level slightly greater than the driving signal SL, in compared with the driving circuit according to the prior art, the present embodiment can reduce the power consumption of the driving circuit by approximately 45%.

FIG. 5A shows a circuit diagram of the power circuit according to the second embodiment of the present invention. As shown in the figure, the power supply circuit 141 according to the present embodiment is a charge pump circuit with multiple modes, which comprises a plurality of switches $M_3$, $M_4$, $M_5$, $M_6$, $M_7$, $M_8$, $M_9$, $M_{10}$, $M_{11}$, $M_{12}$ and a plurality of capacitors $C_1$, $C_2$. A first terminal of the switch $M_3$ is coupled to the input power supply voltage $V_{IN}$; a second terminal of the switch $M_3$ is coupled to a first terminal of the capacitor $C_1$ and a first terminal of the switch $M_4$. A second terminal of the switch $M_4$ is coupled to an output. A first terminal of the switch $M_5$ is coupled to a second terminal of the capacitor $C_1$, a second terminal of the switch $M_6$, and a second terminal of the switch $M_{11}$; a second terminal of the switch $M_5$ is coupled to the ground. A first terminal of the switch $M_6$ is coupled to the output. A first terminal of the switch $M_7$ is coupled to the input power supply voltage $V_{IN}$; a second terminal of the switch $M_7$ is coupled to a first terminal of the switch $M_{11}$, a second terminal of the switch $M_8$, and a first terminal of the capacitor $C_2$. A first terminal of the switch $M_8$ is coupled to the output. A first terminal of the switch $M_9$ is coupled to the input power supply voltage $V_{IN}$; a second terminal of the switch $M_9$ is coupled to a second terminal of the capacitor $C_2$, a second terminal of the switch $M_{10}$, and a second terminal of the switch $M_{12}$. A first terminal of the switch $M_{10}$ is coupled to the output. A first terminal of the switch $M_{12}$ is coupled to the ground.

The charge pump with multiple modes controls different switches for two periods until different times voltage are output. In the first period, only switches M3 、 M11 、 M12 are turned on to allow the input power supply voltage $V_{IN}$ charge the capacitors C1 、 C2. In the second period, only switches M5 、 M4 、 M12 、 M8 are turned on to allow the capacitors C1 、 C2 output a charged voltage to AP in parallel connection. During the cycles of the first and second periods, half of the input power VIN is obtained. One time the input power supply voltage $V_{IN}$ is obtained while the switches M3 、 M4 both are turned on. Three of second times the input power supply voltage $V_{IN}$ is obtained while only the switches M3 、 M11 、 M12 in the first period are turned on and only the switches M9 、 M8 、 M13 in the second period are turned on. Two times the input power supply voltage $V_{IN}$ is obtained while only the switches M3 、 M5 、 M9 、 M8 in the first period are turned on and only the switches M13, M4, M7, M12 in the second period are turned on.

Please refer to FIG. 5B again. As shown in the figure, because the driving power supply voltage AP increases stepwise and gradually to the predetermined level AVDD via four steps from the voltage level slightly greater than the driving signal SL, in compared with the driving circuit according to the prior art, the driving circuit according to the present embodiment can reduce the power consumption by approximately 39%.

To sum up, the driving circuit for display panel according to the present invention comprises a power supply circuit and a driving unit. During the process of charging the display panel by the data driving circuit, the voltage level of the driving power voltage output by the power supply circuit increases gradually form a low level to a predetermined level for reducing the power consumption of the driving circuit.

Accordingly, the present invention conforms to the legal requirements owing to its novelty, nonobviousness, and utility. However, the foregoing description is only embodiments of the present invention, not used to limit the scope and range of the present invention. Those equivalent changes or modifications made according to the shape, structure, feature, or spirit described in the claims of the present invention are included in the appended claims of the present invention.

The invention claimed is:

1. A driving circuit for display panel, comprising: a power supply circuit, outputting a driving power supply voltage; and a driving component, producing a driving signal according to a data signal and said driving power supply voltage for driving a display panel, a voltage level of said driving signal increasing from a low voltage level to a voltage level of said data signal; wherein a voltage level of said driving power supply voltage of said power supply circuit increases stepwise and gradually from a low voltage level to a predetermined voltage level at the same time said driving signal is increasing and charging said display panel.

2. The driving circuit of claim 1, wherein said power supply circuit comprises a charge pump circuit, producing said driving power supply voltage according to an input power supply voltage, and said driving power supply voltage increasing stepwise to said predetermined voltage level.

3. The driving circuit of claim 2, wherein said charge pump circuit comprises:

a first switch, having a first terminal coupled to said input power supply voltage, and turned on or off according to a first switching signal;

a second switch, having a first terminal coupled to a second terminal of said first switch, and turned on or off according to a second switching signal;

a first capacitor, having a first terminal coupled to said first terminal of said second switch;

a third switch, having a first terminal coupled to a second terminal of said first capacitor, having a second terminal coupled a ground, and turned on or off according to a third switching signal;

a fourth switch, having a first terminal coupled to an output, having a second terminal coupled to said first terminal of said third switch, and turned on or off according to a fourth switching signal;

a fifth switch, having a first terminal coupled to said input power supply voltage, and turned on or off according to a fifth switching signal;

a sixth switch, having a first terminal coupled to said output, having a second terminal coupled to a second terminal of said fifth switch, and turned on or off according a sixth switching signal;

a second capacitor, having a first terminal coupled to said second terminal of said sixth switch;

a seventh switch, having a first terminal coupled to said input power supply voltage, and turned on or off according to a seventh switching signal;

a ninth switch, having a first terminal coupled to said first terminal of said second capacitor, having a second terminal coupled to said second terminal of said first capacitor, and turned on or off according to a ninth switching signal;

an eighth switch, having a first terminal coupled to said output, having a second terminal coupled to a second terminal of said second capacitor and a second terminal of said ninth switch, and turned on or off according to an eighth switch; and a tenth switch, having a first terminal coupled to said ground, having a second terminal coupled to said second terminal of said second capacitor, and turned on or off according to a tenth switching signal;

where said power supply voltage charges said first capacitor and said second capacitor according to the on or off statuses of said switches, or said first capacitor and said second capacitor discharge according to the on or off statuses of said switches for producing said driving power supply voltage.

4. The driving circuit of claim 1, and applied to a data driving circuit of said display panel.

5. The driving circuit of claim 1 and further comprising a digital-to-analog converting circuit, converting an input signal for producing said data signal.

6. The driving circuit of claim 5, and further comprising a gamma circuit, producing and transmitting said input signal to said digital-to-analog converting circuit according to a gamma curve.

* * * * *